US007325531B2

(12) United States Patent
Suzuki

(10) Patent No.: US 7,325,531 B2
(45) Date of Patent: Feb. 5, 2008

(54) INTAKE STRUCTURE FOR V-TYPE INTERNAL COMBUSTION ENGINE

(75) Inventor: Shosuke Suzuki, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/511,325

(22) Filed: Aug. 29, 2006

(65) Prior Publication Data

US 2007/0044757 A1 Mar. 1, 2007

(30) Foreign Application Priority Data

Aug. 31, 2005 (JP) ..... 2005-251807
Apr. 25, 2006 (JP) ..... 2006-120505

(51) Int. Cl.
*F02D 9/02* (2006.01)

(52) U.S. Cl. ..... 123/336; 123/337; 123/339.23; 123/339.27

(58) Field of Classification Search ..... 123/336, 123/337, 339.23, 339.27
See application file for complete search history.

(56) References Cited

U.S. PATENT DOCUMENTS 6,481,411 B1 * 11/2002 Katayama ..... 123/339.23
6,585,547 B2 * 7/2003 Tsubouchi et al. ..... 123/339.23
6,739,313 B2 * 5/2004 Watanabe ..... 123/339.23
7,231,899 B2 * 6/2007 Wakamori et al. ..... 123/336
7,263,969 B2 * 9/2007 Sakamoto ..... 123/336

FOREIGN PATENT DOCUMENTS

JP 2002-89415 A 3/2002

* cited by examiner

*Primary Examiner*—Erick Solis
(74) *Attorney, Agent, or Firm*—Birch, Stewart, Kolasch & Birch, LLP

(57) ABSTRACT

An intake structure is provided for a V-type internal combustion engine having cylinders banked in a V pattern. A throttle body includes a throttle valve interposed in an intake passage extending to the inner side of the V banks and bent to be parallel to a crankshaft. The throttle body is provided with a bypass passage bypassing the throttle valve. An idle control valve for opening and closing the bypass passage by being moved in a direction orthogonal to the intake passage parallel to the crankshaft is added to the throttle body. A drive shaft for moving the idle control valve is projected from an electric actuator in the state of being directed in the moving direction of the idle control valve. The resulting configuration makes it possible to reduce the size of a throttle body and to suppress the overall width of the engine.

20 Claims, 14 Drawing Sheets

INTAKE STRUCTURE FOR V-TYPE INTERNAL COMBUSTION ENGINE

CROSS-REFERENCE TO RELATED APPLICATION

The present application claims priority under 35 U.S.C. §119 to Japanese Patent Application No. 2005-251807, filed Aug. 31, 2005, and Japanese Patent Application No. 2006-120505, filed Apr. 25, 2006, the entire contents of which are hereby incorporated by reference.

BACKGROUND OF THE INVENTION

1. Field of the Invention

The present invention relates to an intake structure in a V-type internal combustion engine having cylinders banked in V pattern.

2. Description of Background Art

There is an example of a motorcycle with a front-rear V-type internal combustion engine mounted thereon, wherein a throttle body is interposed in an intake passage extended to the inside of the V banks of the V-type internal combustion engine and bent to be parallel to a crankshaft (for example, see Japanese Patent Laid-open No. 2002-89415).

The throttle body disclosed in Japanese Patent Laid-open No. 2002-89415 is provided with a bypass passage bypassing a throttle valve, and the bypass passage is opened and closed by a bypass valve, according to the structure disclosed.

The bypass valve is driven to open and close by a valve body drive mechanism for driving through expansion and contraction of a wax.

In Japanese Patent Laid-open No. 2002-89415, the direction in which the bypass valve is moved to open and close is the direction in which the intake passage bent to be parallel to a crankshaft is directed, i.e., the direction in which the crankshaft is directed (the width direction of a vehicle body and the V-type internal combustion engine), and a drive shaft of the valve body drive mechanism is disposed coaxially with the moving direction of the bypass valve.

Therefore, the valve body drive mechanism filled with the wax, the drive shaft and the bypass valve are aligned rectilinearly in the width direction of the internal combustion engine, so that the throttle body comprising these elements tends to be large in the width direction.

In Japanese Patent Laid-open No. 2002-89415, the valve body drive mechanism is designed for driving through the expansion and contraction of the wax, so that the throttle body is composed substantially of the valve body drive mechanism itself, and the throttle body may not necessarily be so large in the width direction. When an electric actuator is adopted, the throttle body is more enlarged in the width direction, and an air cleaner disposed on a lateral side of the throttle body is more projected to the lateral side, thereby enlarging the vehicle width and widening the distance between the knees of the rider.

SUMMARY AND OBJECTS OF THE INVENTION

The present invention has been made in consideration of the above-mentioned points. Accordingly, it is an object of the present invention to provide an intake structure for a V-type internal combustion engine by which it is possible to contrive a reduction in the size of a throttle body having an idle control valve driven by an electric actuator, and to suppress the overall width of the internal combustion engine.

In order to attain the above object, according to a first aspect of the present invention, an intake structure is provided for a V-type internal combustion engine having cylinders banked in V pattern. A throttle body having a throttle valve is interposed in an intake passage extended to the inside of the V banks and bent to be parallel to a crankshaft. The throttle body is provided with a bypass passage bypassing the throttle valve. An idle control valve for opening and closing the bypass passage by being moved in a direction orthogonal to the intake passage parallel to the crankshaft is added to the throttle body; and a drive shaft for moving the idle control valve is projected from an electric actuator in the state of being directed in the moving direction of the idle control valve.

According to a second aspect of the present invention, the idle control valve is disposed on the upper side of the throttle body.

According to a third aspect of the present invention, the center axes of the cylinders opposed to each other in V pattern are on the same plane orthogonal to the crankshaft, and the idle control valve is located within the width of the internal combustion engine in the direction in which the crankshaft is directed.

According to a fourth aspect of the present invention, the throttle body is provided with a throttle sensor for detecting the opening of the intake passage by the throttle valve, and the electronic actuator is provided on the same side as the throttle sensor in the throttle body.

According to the first aspect of the invention, the idle control valve for opening and closing the bypass passage by being moved in a direction orthogonal to the intake passage parallel to the crankshaft is added to the throttle body, and the drive shaft for moving the idle control valve is projected from the electric actuator in the state of being directed in the moving direction of the idle control valve. Therefore, the electric actuator, the drive shaft thereof and the idle control valve are aligned in a direction orthogonal to the intake passage parallel to the crankshaft, and the idle control valve is moved in this direction to thereby open and close the bypass passage. Accordingly, notwithstanding the use of the electric actuator, the throttle body is not enlarged in the width direction, and the overall width of the internal combustion engine can be suppressed to be small.

In addition, since the throttle body is not enlarged in the width direction, the air cleaner disposed on a lateral side of the throttle body would not projected largely to the lateral side to thereby spoil the appearance quality, the possibility of widening too much the distance between the knees of the rider can be obviated, and enhancement of the riding position can be contrived.

According to the second aspect of the invention, the idle control valve is disposed on the upper side of the throttle body. Therefore, the idle control valve can be spaced from the cylinders, and the thermal influence exerted on the idle control valve from the cylinders can be suppressed.

According to the third aspect of the invention, the center axes of the cylinders opposed to each other in V pattern are on the same plane orthogonal to the crankshaft. Therefore, even in a V-type internal combustion engine which is narrow in width, the idle control valve is located within the narrow width, so that the overall width of the internal combustion engine can be kept small.

According to the fourth aspect of the invention, the electric actuator is provided on the same side as the throttle sensor for detecting the opening of the intake passage by the throttle valve, in the throttle body. Therefore, a harness for the throttle sensor and a harness for the electric actuator can be collected on one side, and it is easy to lay the harnesses.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
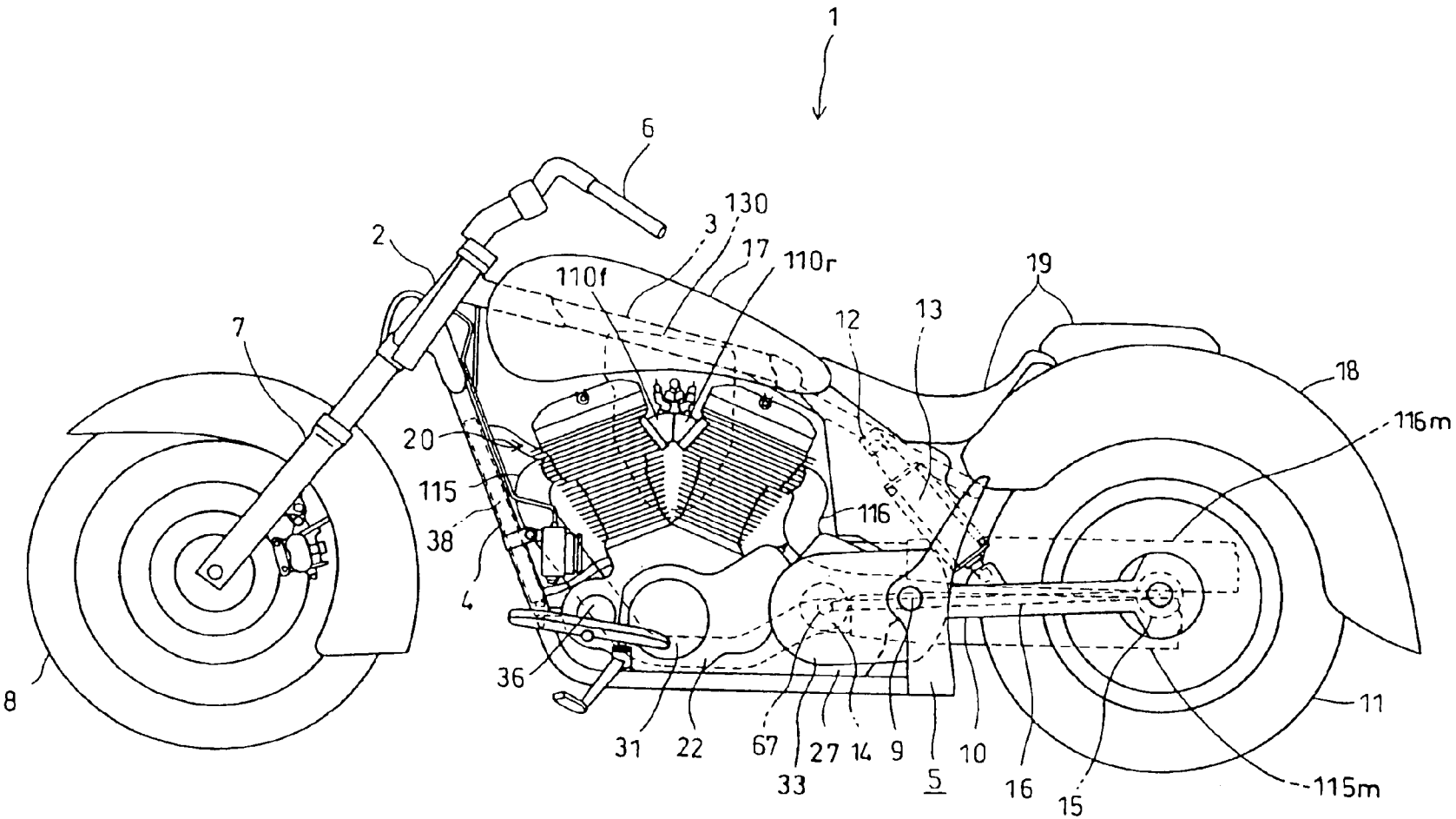
FIG. 1 is an overall left side view of a motorcycle according to an embodiment of the present invention.

FIG. 1 is an overall side view of a motorcycle 1 on which an internal combustion engine 20 according to this embodiment is mounted.

The motorcycle 1 has a configuration in which a main frame 3 extends from a head pipe 2, down tubes 4 in a bifurcated state extend downwards from the head pipe 2, and the down tubes 4 are bent at their lower ends to extend rearwards.

A radiator 38 is supported between the down tubes 4. Bifurcated rear ends of the main frame 3 and the rear ends of the down tubes 4 are connected to each other through a left-right pair of pivot frames 5.

A front fork 7 rotatably supported by the head pipe 2, extending upwards, and turned by a steering handle 6 extended to the left and right side extends downwards, and a front wheel 8 is rotatably supported on the tip ends of the front fork 7.

A rear wheel 11 is rotatably supported on the rear ends of a rear fork 10, of which the front end is movably supported on the pivot frames 5 through a pivot shaft 9 and which can be swung vertically. A rear cushion 13 is interposed between a bracket 12 provided on the main frame 3 and the rear fork 10 which can be swung vertically.

An internal combustion engine 20 is mounted in a space surrounded by the main frame 3, the down tubes 4 and the pivot frames 5 in the state of being supported on the front and rear sides. A drive gear 14 fitted to a counter shaft 67 projected to the left side from a mission case 27 on the rear side of a crankcase 22 of the internal combustion engine 20 and a driven gear 15 fitted to a rear axle integral with the rear wheel 11 are connected to each other through a drive shaft 16, whereby power is transmitted to the rear wheel 11.

A fuel tank 17 is supported so as to be astride the main frame 3, a rear fender 18 extended rearwards from upper portions of the pivot frames 5 covers the upper side of the rear wheel 11, and a seat 19 is provided between the fuel tank 17 and the rear fender 18 and on the upper side of the rear fender 18.

The internal combustion engine 20 is a front-rear V-type 2-cylinder water-cooled 4-stroke-cycle internal combustion engine which is mounted in a transverse mode, i.e., with a crankshaft 21 directed in a left-right horizontal direction relative to the vehicle body, and in which the cylinders are banked on the front and rear sides in V pattern.

The front-rear V-type 2-cylinder internal combustion engine 20 has a configuration in which a front bank cylinder 23*f* and a rear bank cylinder 23*r* are extended skewly upwards from the crankcase 22, cylinder heads 24*f* and 24*r* are laid on the cylinders 23*f* and 23*r*, and cylinder head covers 26*f* and 26*r* are disposed on the upper side of the cylinder heads 24*f* and 24*r* with rocker arm holders 25*f* and 25*r* therebetween.

Water jackets 23*fw* and 23*rw* are formed in the surroundings of cylinder bores of the front bank cylinder 23*f* and the rear bank cylinder 23*r*.

Figure 4:
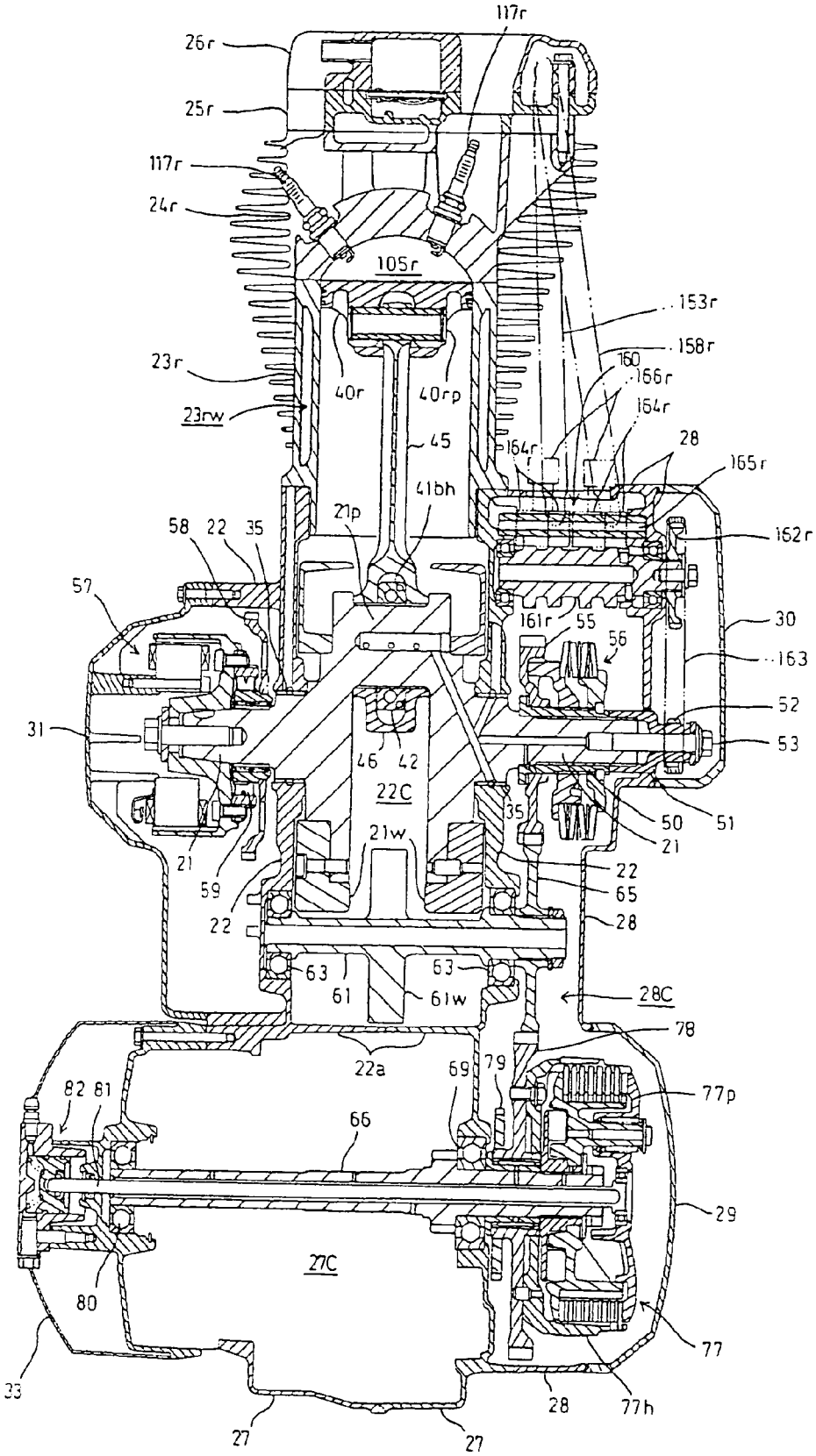
FIG. 4 is a sectional view taken along line IV-IV of FIG. 2.

Referring to FIG. 4, the mission case 27 is integrally formed on the rear side of the crankcase 22, with a partition wall 22*a* therebetween to partition them from each other. The crankcase 22 and the mission case 27 are each structured to be separable to the left and right sides, and a clutch gear case 28 is added to the right side of the right-side crankcase 22 and mission case 27.

The clutch gear case 28 is provided, on the side of the mission case on the rear side, with an opening which is opened to the right side, and the opening is covered with a clutch cover 29.

Therefore, a crank chamber 22C is defined by the crankcase 22 and the partition wall 22*a*, a mission chamber 27C is defined by the mission case 27 and the partition wall 22*a*, and a clutch chamber 28C is formed in the state of being partitioned by the right-side crankcase 22 and mission case 27 and being covered with the clutch gear case 28 and the clutch cover 29.

Incidentally, the right side of a front side wall of the clutch gear case 28 is covered with a chain cover 30, the left side of the left-side crankcase 22 is covered with a side cover 36 (see FIG. 1) and an ACG cover 31, and the left side of the left-side mission case 27 is covered with a clutch drive mechanism cover 33.

The front-rear V-type internal combustion engine 20 has a configuration in which the cylinder center axes of the front bank cylinder 23*f* and the rear bank cylinder 23*r* are on the same plane orthogonal to the crankshaft 21, and are not set off in the left-right width direction.

A front-side connecting rod 41 having a small end portion connected to a piston pin 40*fp* of a piston 40*f* reciprocated in the front bank cylinder 23*f* and a rear-side connecting rod 45 having a small end portion connected to a piston pin 40*rp* of a piston 40*r* reciprocated in the rear bank cylinder 23*r* have their big end portions connected to a common crank pin 21*p* provided for connection between a pair of crank webs 21*w*, 21*w* of the crankshaft 21.

Figure 11:
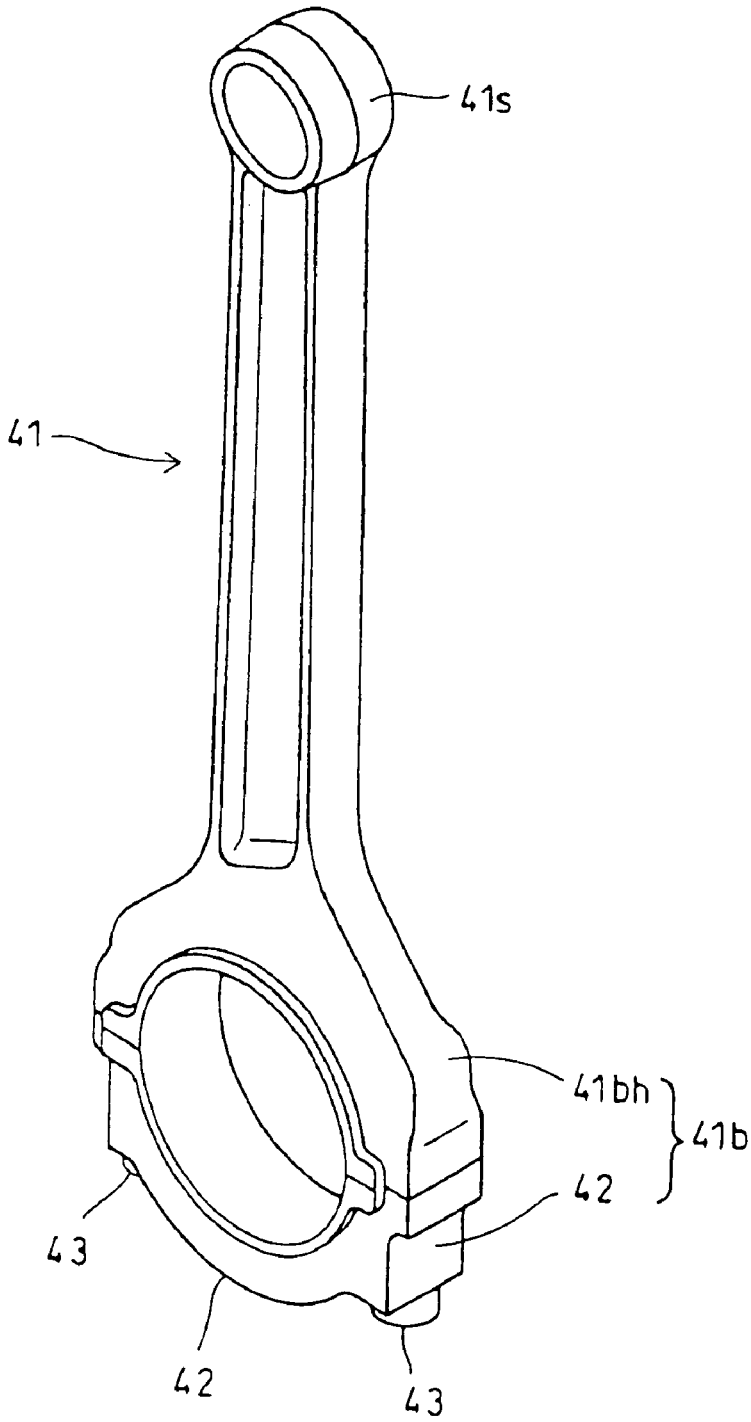
FIG. 11 is a perspective view of a front-side connecting rod.

As shown in FIG. 11, the front-side connecting rod 41 is integrally provided with the small end portion 41*s* at one end thereof, its big diameter portion 41*b* on the other end thereof is separable in two at a plane perpendicular to the rod axis thereof, a semi-circular arcuate connecting rod cap 42 is mated with a semi-circular arcuate big end portion 41*bh* on the side of the main body of the connecting rod 41, with the crank pin 21*p* therebetween, and both ends of the connecting rod cap 41 and the big end portion 41*bh* are connected by connecting rod bolts 43.

Figure 12:
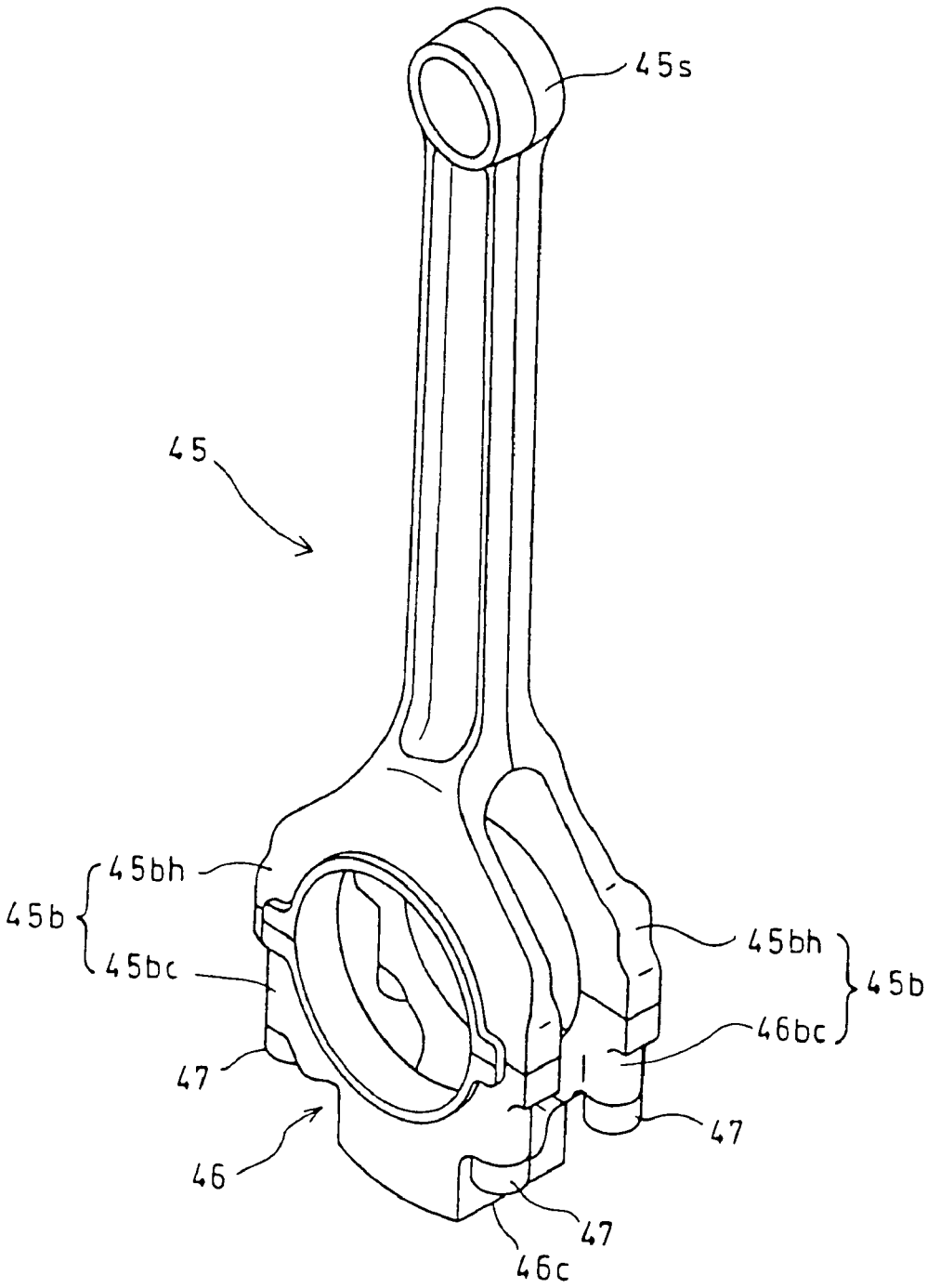
FIG. 12 is a perspective view of the rear-side connecting rod.
Figure 13:
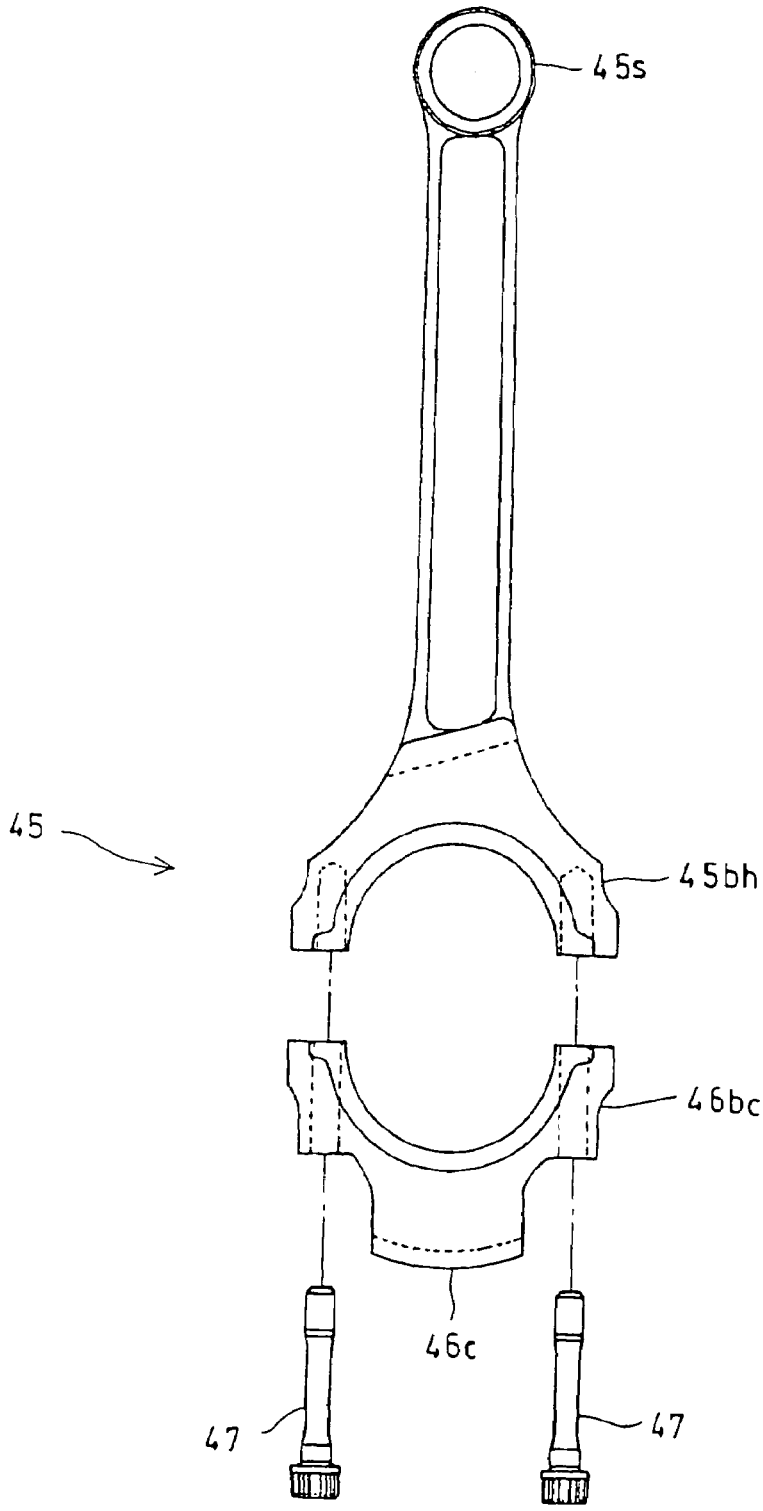
FIG. 13 is an exploded side view of the rear-side connecting rod.
Figure 14:
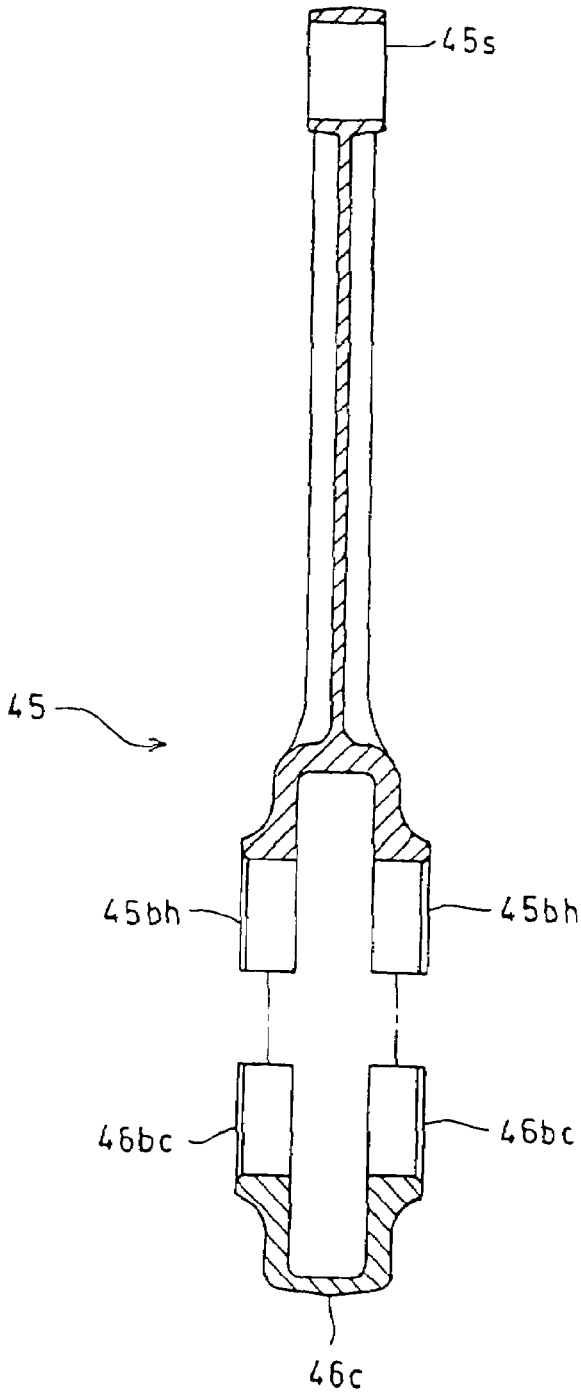
FIG. 14 is an exploded sectional view of the rear-side connecting rod.

On the other hand, as shown in FIGS. 12 to 14, the rear-side connecting rod 45 is integrally provided with the small end portion 45*s* at one end thereof, similarly to the above, and its big end portion at the other end thereof is bifurcated into a pair of big end portions 45*b*, 45*b*, which are each separable in two at a plane perpendicular to the rod axis.

Specifically, the pair of big end portions 45*b*, 45*b* are so configured that a connecting rod cap 46 formed by integrating a pair of semi-circular arcuate big end halves 46*bc*, 46*bc* while projecting their central portions to the outside (in the centrifugal direction) and connecting the projected portions by a connecting projected portion 46*c* is mated with a pair of bifurcated semi-circular arcuate big end half portions 45*bh*, 45*bh* on the side of the main body of the connecting rod 45, and the four corners of the thus mated portions are fastened by connecting rod bolts 47 on both lateral sides of the connecting projected portion 46*c*.

The pair of big end portions 45*b*, 45*b* of the rear-side connecting rod 45 clamps the big end portion 41*b* of the front-side connecting rod 41 therebetween, and are rotatably supported on the crank pin 21*p* on both sides of the big end portion 41*b* (see FIG. 4).

Figure 2:
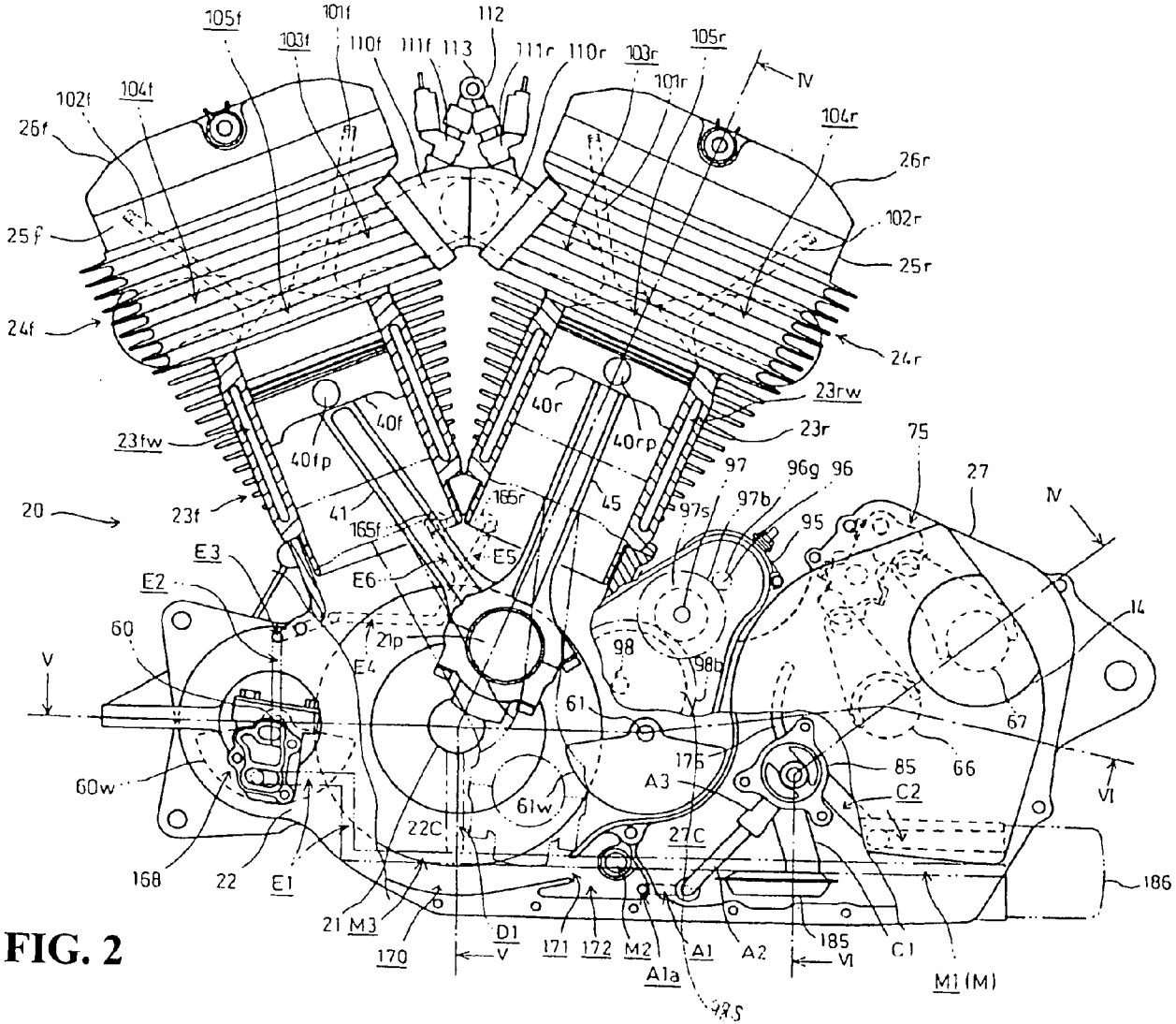
FIG. 2 is a partly sectional left side view of a V-type internal combustion engine.
Figure 10:
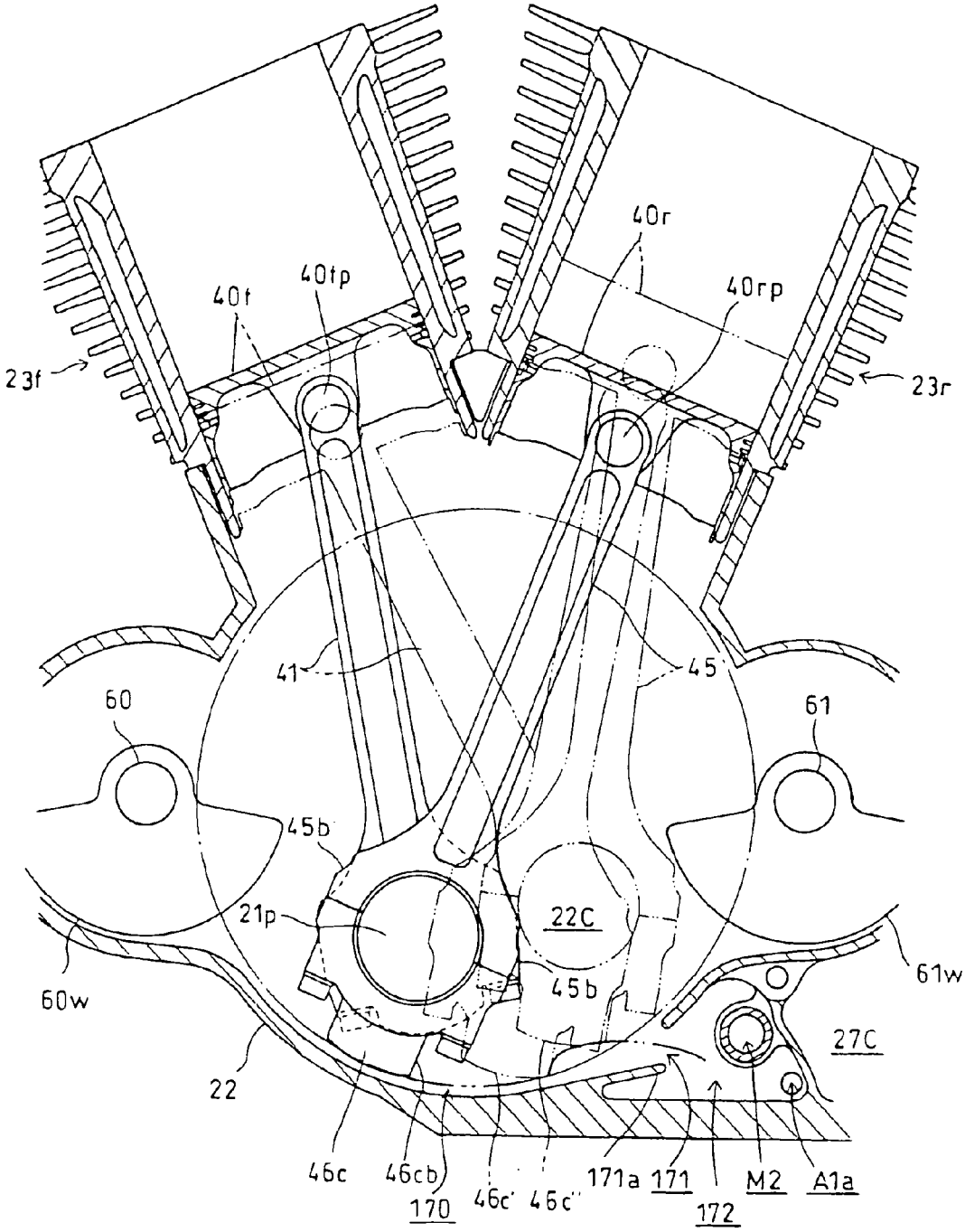
FIG. 10 is an illustration of the motion of a rear-side connecting rod.

The rear-side connecting rod 45 has a configuration in which the connecting projected portion 46*c* of the connecting rod cap 46 constituting the pair of big end portions 45*b*, 45*b* is particularly largely projected downwards (see FIGS. 2 and 10).

Thus, the one big end portion 41*b* of the front-side connecting rod 41 and the pair of big end portions 45*b*, 45*b* of the rear-side connecting rod 45 are rotatably supported on the common same crank pin 21*p*, with the big end portion 41*b* located at the center and with the pair of big end portions 45*b*, 45*b* located on both sides; therefore, coupling vibration is prevented from being generated.

Incidentally, the pair of big end portions 45*b*, 45*b* of the rear-side connecting rod 45 are so assembled that the connecting projected portion 46*c* of the connecting rod cap 46 thereof is located astride the connecting rod cap 42 of the front-side connecting rod 41, so that both of them do not interfere with each other.

In addition, since the cylinder center axes of the front bank cylinder 23*f* and the rear bank cylinder 23*r* are on the same plane orthogonal to the crankshaft 21 and are not set off in the left-right width direction, the left-right width of the internal combustion engine 20 can be set small.

The crankshaft 21 connected to the front-side connecting rod 41 and the rear-side connecting rod 45 through the common crank pin 21*p* and driven to rotate is rotatably supported on the left and right crankcases 22 through bearings 35, 35.

A sleeve 50 is fitted to a portion, projecting into the clutch chamber 28C on the right side, of the crankshaft 21. Further, a cap 51 provided with a drive sprocket 52 is fitted over, and integrally attached through a bolt 53 to, the tip end of the projecting portion.

The tip end of the cap 51 provided with the drive sprocket 52 is projecting rightwards through an opening in the clutch gear case 28. A primary gear 55 is rotatably supported on the sleeve 50, and the rotation of the crankshaft 21 is transmitted thereto through a damper mechanism 56.

An AC generator 57 is provided at a portion, projecting to the left side of the left-side crankcase 22, of the crankshaft 21, and a driven gear 58 of a starting mechanism is provided thereat, with a one-way clutch 59 therebetween.

At front and rear symmetrical positions of the crankshaft 21, balancer shafts 60, 61 for canceling primary vibration are disposed in parallel to each other on a substantially horizontal plane, which is the same as that of the crankshaft 21, to constitute a two-shaft balancer mechanism.

The front-side balancer shaft 60 is rotatably supported on the left and right crankcases 22, 22 through bearings 62, 62 (see FIG. 5), and the rear-side balancer shaft 61 is rotatably supported on the left and right crankcases 22, 22 through bearings 63, 63 (see FIG. 4).

Balancer weights 61*w*, 61*w* of the front and rear balancer shafts 60, 61 are swiveled between the pair of crank webs 21*w*, 21*w* of the crankshaft 21.

The balancer shafts 60, 61 penetrate through the bearings 62, 63 for rotatably supporting them on the right-side crankcase 22, then they project into the clutch chamber 28C, and the balancer gears 64, 65 are fitted to the right projecting ends of them. The front and rear balancer gears 64, 65 are meshed with the primary gear 55 (having the same diameter) provided on the crankshaft 21. This ensures that the balancer shafts 60 and 61 are reversely rotated in conjunction with the rotation of the crankshaft 21, at the same rotating speed.

A main shaft 66 and a counter shaft 67 are disposed on the rear side of the rear-side balancer shaft 61, in the state of being rotatably supported on the mission case 27.

The counter shaft 67 disposed on the skewly upper rear side of the main shaft 66 has both ends rotatably supported on the left and right mission cases 27 through bearings, and a speed change shift mechanism 75 is disposed on the upper side of the main shaft 66. The drive gear 14 is fitted to the left end, projecting to the outside of the mission chamber 27C, of the counter shaft 67.

A multiple disk clutch 77 is provided at the right end, projecting to the outside of the mission chamber 27C, of the main shaft 66. A main gear 78 provided as one body with a clutch housing 77*h*, rotatably supported on the main shaft 66, of the multiple disk clutch 77 is meshed with the balancer gear 65 of the rear-side balancer shaft 61.

Incidentally, the main gear 78 is integrally formed with an oil pump gear 79.

A clutch operating shaft 81 penetrates through a center hole in the main shaft 66, the right end thereof is connected to a pressure plate 77*p* of the multiple disk clutch 77, and the left end thereof is mounted in a clutch drive mechanism 82 provided in the clutch drive mechanism cover 33.

Therefore, when the crankshaft 21 is rotated by the operation of the internal combustion engine 20, the primary gear 55 is rotated through the operation of the damper mechanism 56, and the rotation of the primary gear 55 rotates the front and rear balancer shafts 60, 61 through the front and rear balancer gears 64, 65 meshed with the primary gear 55.

The rotation of the balancer gear 65 of the rear-side balancer shaft 61 rotates the clutch housing 77*h* of the multiple disk clutch 77 through the main gear 78 meshed with the balancer gear 65, and rotates the main shaft 66 through the engagement of the multiple disk clutch 77.

The rotation of the main shaft 66 rotates the counter shaft 67 through selective making of one of the meshings of the corresponding gears in the main gear train and the counter gear train effected by the speed change shift mechanism 75, and the rotation of the counter gear 67 is accompanied by the rotation of the drive gear 14 integrally fitted thereto, driving the rear wheel 11 to rotate through the function of the drive shaft 16 serving for connection between the drive gear 14 and the driven gear 15.

In addition, in the mission chamber 27C, an oil pump 85 is disposed on the skewly lower front side of the main shaft 66 (see FIG. 2).

Figure 6:
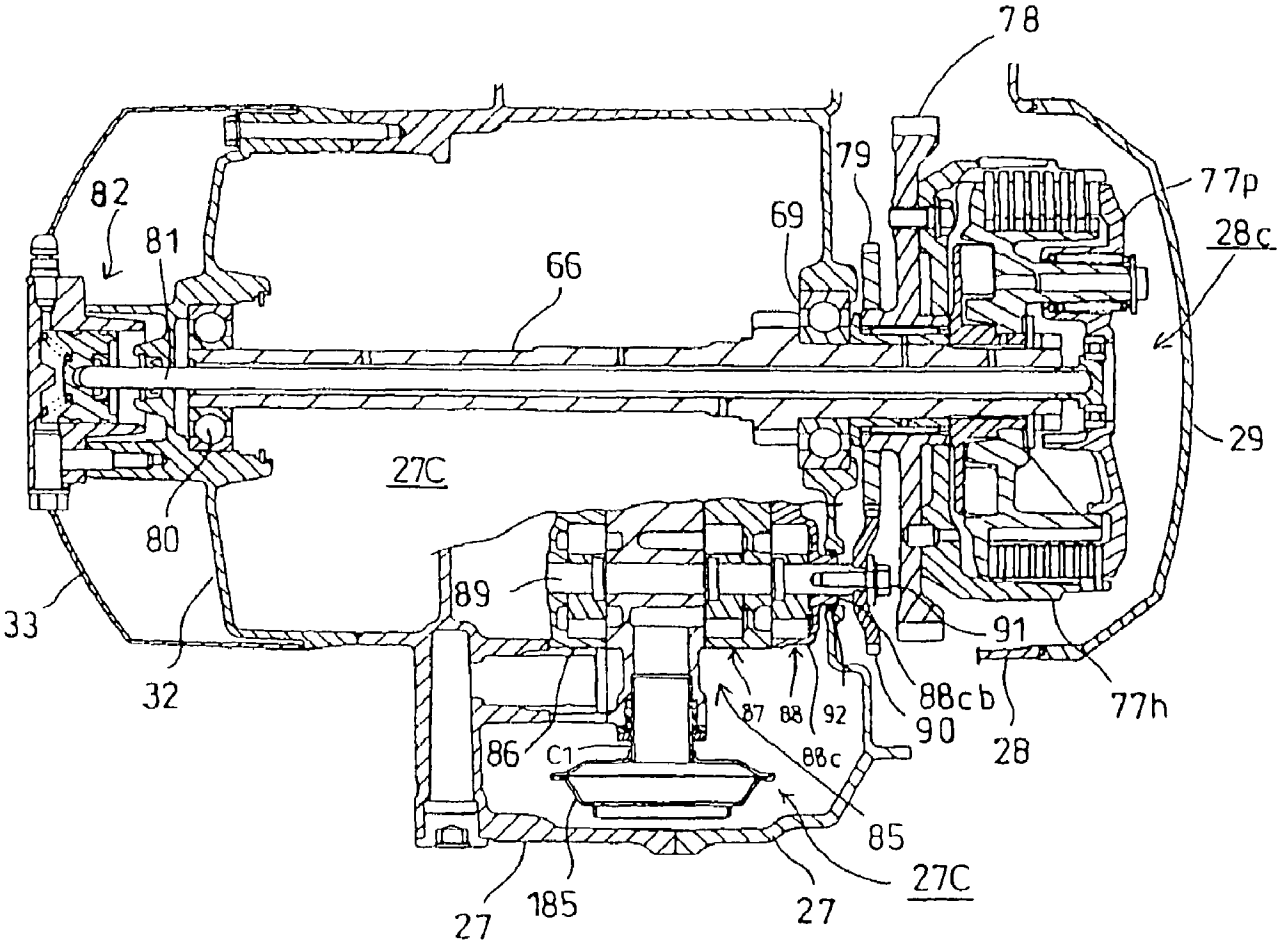
FIG. 6 is a sectional view taken along line VI-VI of FIG. 2.

As shown in FIG. 6, the oil pump 85 includes a crank chamber scavenging pump 86, a feed pump 87, and a clutch chamber scavenging pump 88 in this order from the left side, and inner rotors of the three pumps are fitted to a common rotating shaft 89 directed in the left-right direction.

A bearing portion 88*cb* formed at the center of a right side wall of a pump case 88*c* of the clutch chamber scavenging pump 88 on the right side is projected and inserted into a circular hole in the right-side mission case 27, and the rotating shaft 89 penetrates through the bearing portion 88*cb*, to project into the clutch chamber 28C. A pump drive gear 90 is attached to the projecting portion of the rotating shaft 89 by a bolt 91, and the pump drive gear 90 is meshed with the oil pump gear 79.

Therefore, when the rotation of the crankshaft 21 is transmitted through the primary gear 55, the balancer gear 65 and the main gear 78 to rotate the oil pump drive gear 79 integral with the main gear 78, the pump drive gear 90 meshed with the oil pump drive gear 79 is rotated, whereby the oil pump 85 is driven.

Incidentally, the bearing portion 88*cb* inserted into the circular hole in the right-side mission case 27 from the side of the mission chamber 27C is fitted with an oil seal 92 in a gap between the bearing portion 88*cb* and the circular hole, whereby the mission chamber 27C and the clutch chamber 28C are sealed from each other (see FIG. 6).

On the other hand, a starter motor 95 is disposed on the rear side of a mating portion of the crankcase 22 for mating with the rear bank cylinder 23*r* in the condition where its drive shaft 96 projects leftwards. As shown in FIG. 2, a big diameter gear 97*b* on a speed reduction gear shaft 97 is meshed with a drive gear 96*g* formed on the drive shaft 96, a big diameter intermediate gear 98*b* on an intermediate shaft 98 is meshed with a small diameter gear 97*s* on the speed reduction gear shaft 97, and a small diameter intermediate gear 98*s* on the intermediate shaft 98 is meshed with the driven gear 58 on the crankshaft 21.

Therefore, the rotation of the starter motor 95 is transmitted sequentially through the drive gear 96*g*, the big diameter gear 97*b*, the small diameter gear 97*s*, the big diameter intermediate gear 98*b*, the small diameter intermediate gear 98*s*, and the driven gear 58, and through the one-way clutch 59 to drive the crankshaft 21 to rotate, whereby the internal combustion engine 20 can be started.

Now, intake and exhaust systems will be described below.

The internal combustion engine 20 is an OHV type internal combustion engine, in which intake valves 101*f*, 101*r* and exhaust valves 102*f*, 102*r* are provided in the cylinder heads 24*f*, 24*r*, and a valve operating cam mechanism 160 is provided in the right-side crankcase 22.

The intake valves 101*f*, 101*r* and the exhaust valves 102*f*, 102*r* are so provided as to be able to open and close the openings of intake ports 103*f*, 103*r* and exhaust ports 104*f*, 104*r* opening into combustion chambers 105*f*, 105*r*, respectively.

Incidentally, as shown in FIG. 4, two spark plugs 117*r*, 117*r* are inserted, at left and right positions, into the combustion chamber 105*r* in the rear-side cylinder head 24*r*.

Similarly, though not shown, two spark plugs are inserted into the combustion chamber 105*f* in the front-side cylinder head 24*f*.

In the front-side cylinder head 24*f*, the intake port 103*f* extends rearwards from the combustion chamber 105*f* to be connected to an intake pipe 110*f* between the V banks (see FIG. 2), and the exhaust port 104*f* extends skewly forwardly rightwards from the combustion chamber 105*f* to be connected to an exhaust pipe 115 (see FIG. 1).

On the other hand, in the rear-side cylinder head 24*r*, the intake port 103*r* extends forwards from the combustion chamber 105*r* to be connected to an intake pipe 110*r* between the V banks (see FIG. 2), and the exhaust port 104*r* extends skewly rearwardly rightwards from the combustion chamber 105*r* to be connected to an exhaust pipe 116 (see FIG. 1).

Figure 8:
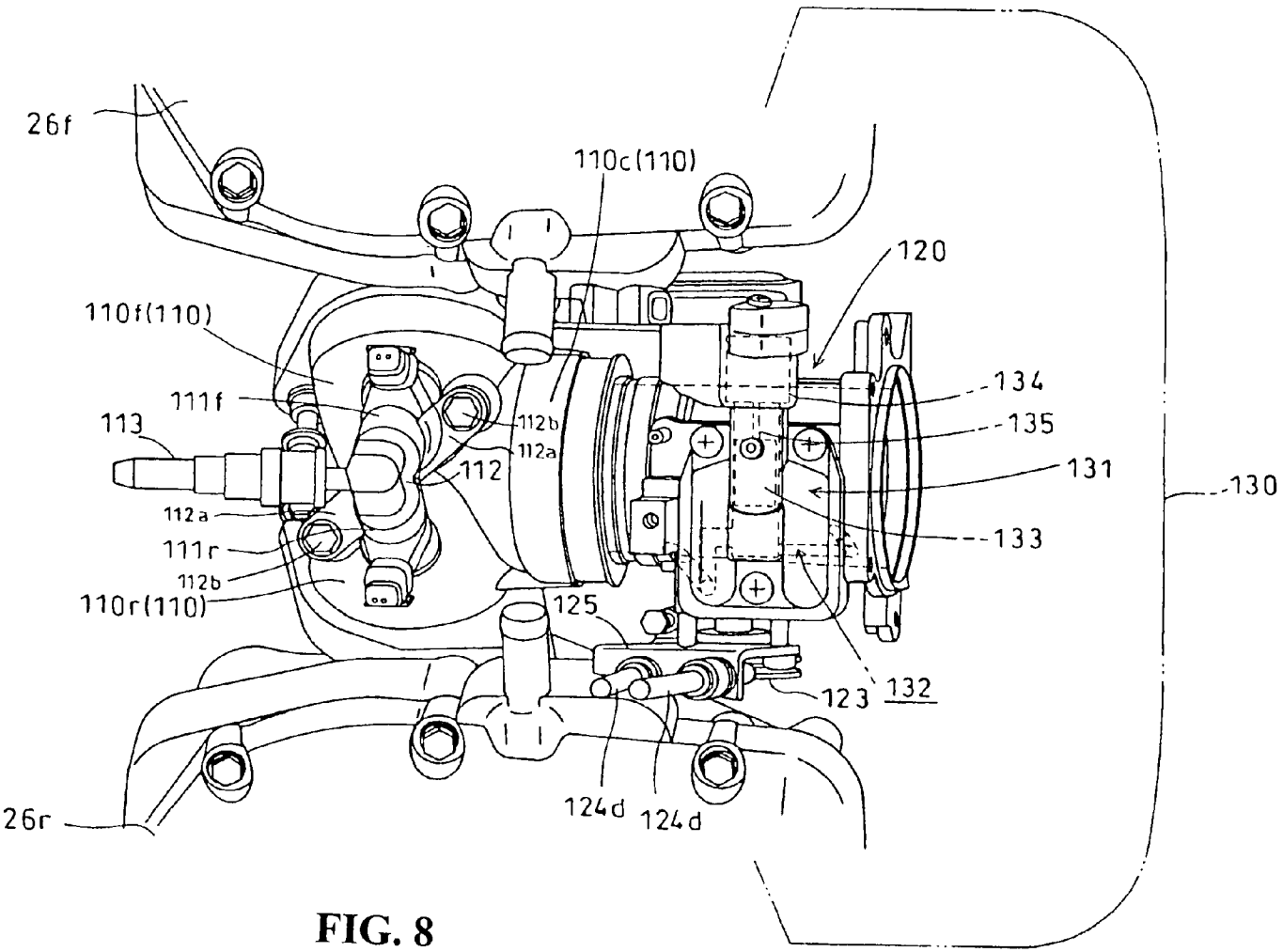
FIG. 8 is a partial top plan view of the inner side of the V banks.

As shown in FIG. 8, the intake pipe 110*f* extended rearwards from the front-side cylinder head 24*f* and the intake pipe 110*r* extended forwards from the rear-side cylinder head 24*r* are branch pipes of an intake pipe 110 which are united at the center and which are formed integrally with an upstream-side intake pipe 110*c* extending rightwards.

A throttle body 120 is connected to the rightwardly extending upstream-side intake pipe 110*c* of the intake pipe 110, and an air cleaner 130 is disposed on the upstream side (right side) of the throttle body 120.

The air cleaner 130 is so disposed as to cover the space between the V banks from the right side, along the right side surfaces of the front and rear cylinders 23*f*, 23*r*, cylinder heads 24*f*, 24*r* and cylinder head covers 26*f*, 26*r* in the V banks.

The intake pipes 110*f*, 10*r*, branched to the front and rear sides, of the intake pipe 110 are fitted with fuel injection valves 111*f*, 111*r* which are projecting skewly upwards, and the upper ends of the fuel injection valves 111*f*, 111*r* are fitted to one common socket 112.

The socket 112 is provided with a joint pipe 113 which is joined to a fuel pipe and which projects leftwards.

The socket 112 has attaching pieces 112*a*, 112*a* extending skew horizontal directions from the lower ends of fitting portions fitted over the fuel injection valves 111*f*, 111*r*, and the attaching pieces 112*a*, 112*a* are fixed to the throttle body 120 by bolts 112*b*, 112*b*.

Figure 9:
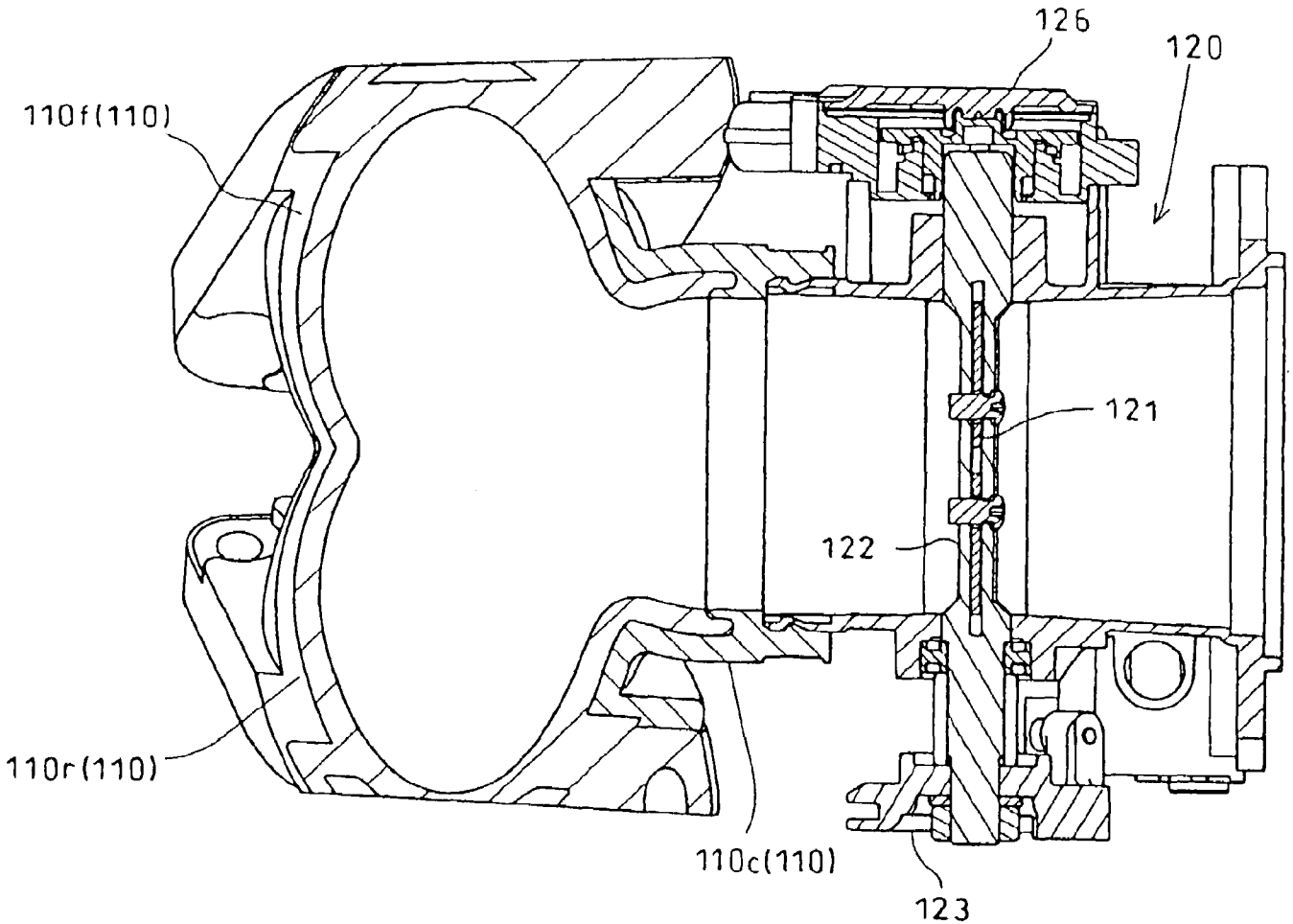
FIG. 9 is a sectional view of the same.

The throttle body 120 provided with an intake passage in the left-right direction on the upstream side of the fuel injection valves 111*f*, 111*r* has a configuration in which a throttle valve shaft 122 of a butterfly type throttle valve 121 is turnably disposed in the front-rear direction, orthogonally to the intake passage (see FIG. 9).

Figure 7:
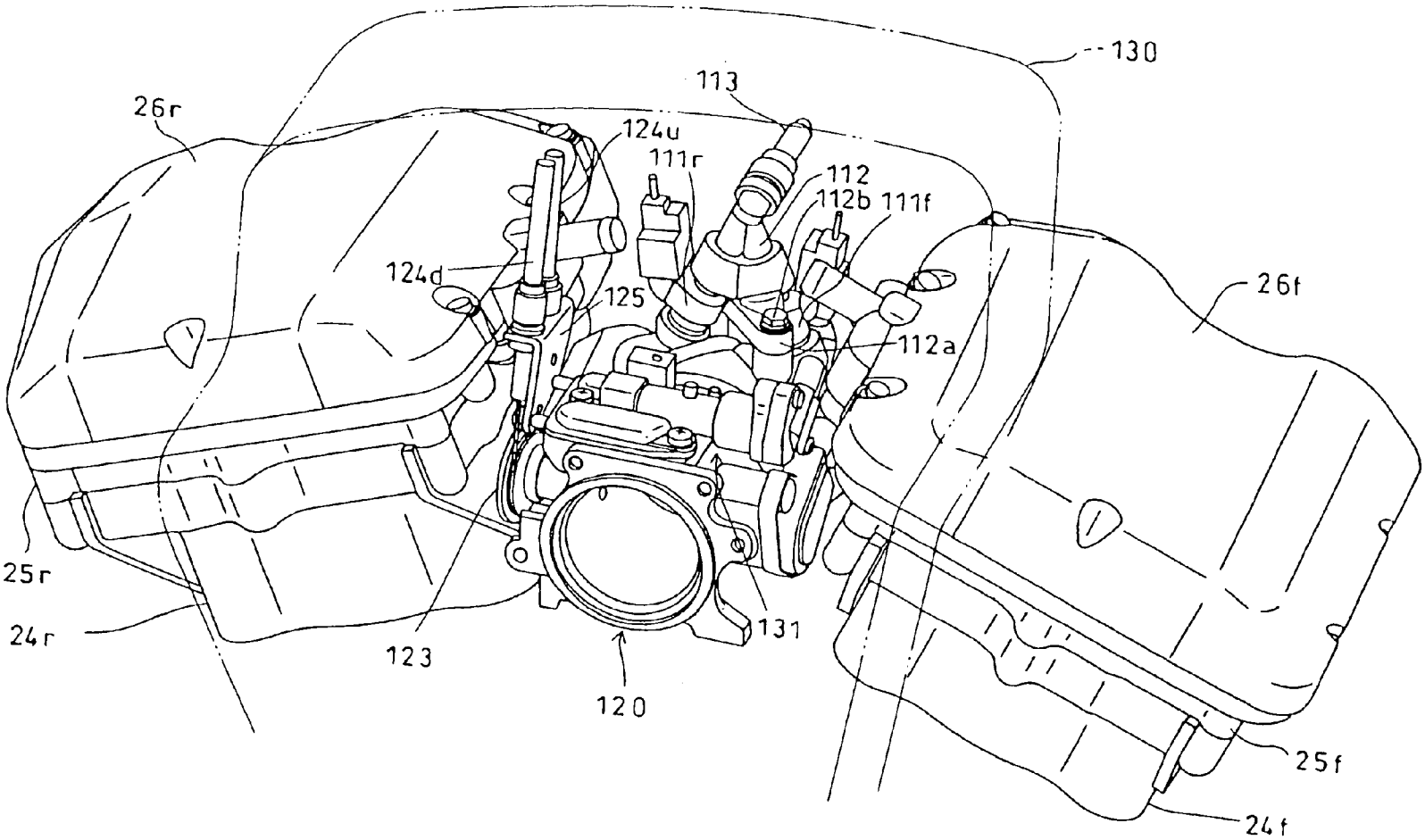
FIG. 7 is a perspective view of an upper portion of the V-type internal combustion engine.

A drive pulley 123 is fitted to a rearwardly projecting end portion of the throttle valve shaft 122, and, as shown in FIG. 7, two throttle wires 124*u*, 124*d* having outers locked to a holder metal 125 attached to the upper side of the drive pulley 123 extend downwards, and have tip ends locked to the drive pulley 123 in the state of being wrapped around in the opposite senses.

The throttle wires 124*u*, 124*d* are extended and contracted in the opposite directions according to an operation of a throttle grip (not shown), and the throttle valve 121 is turned together with the throttle valve shaft 122 through the drive pulley 123, whereby the opening of the intake passage (valve opening) is controlled.

At a forwardly projecting end portion of the throttle valve shaft 122, a throttle sensor 126 for detecting the valve opening of the throttle valve 121 is supported on the throttle body 120. An idle air controller 131 is provided at an upper portion of the throttle body 120.

As indicated by broken lines in FIG. 8, a bypass passage 132 is formed in relation to the intake passage in the throttle body 120 so as to bypass the throttle valve 121 from the upstream side to the downstream side.

An idle control valve 133 is fitted orthogonally to a portion, directed in the left-right direction, of the bypass passage 132 so as to be movable in the front-rear direction, whereby the bypass passage 132 can be opened and closed.

A rotational drive shaft 135 of a motor 134 as an electric actuator disposed on the front side of the idle control valve 133 is, as a ball screw, screw-fitted in the idle control valve 133 serving as a nut member. When the rotational drive shaft 135 is rotated under driving of the motor 134, the idle control valve 133 is slid in the front-rear direction, whereby the communicating condition (valve opening) of the bypass passage 132 can be controlled.

Specifically, during an idling operation wherein the throttle valve 121 is fully closed by the idle air controller 131, it is possible to secure intake air by communication of the bypass passage 132, and to control the intake condition.

On the other hand, as shown in FIG. 1, the exhaust pipe 115 extending skewly forwardly rightwards from the front-side cylinder head 24*f* is bent so as to extend downwards, is bent rearwards along a right side surface of the crankcase 22, and is connected to a muffler 115*m* which is disposed on the right side of the rear wheel 11 so as to be elongate in the front-rear direction.

In addition, the exhaust pipe 116 extending rearwards from the rear-side cylinder head 24*r* is bent so as to extend downwards, is then bent rearwards along a right side surface of the mission case 27, and is connected to a muffler 116*m* which is disposed on the right side of the rear wheel 11 so as to be on the upper side of and in parallel to the muffler 115.

Now, the mechanism of a valve operating system will be described below.

Figure 3:
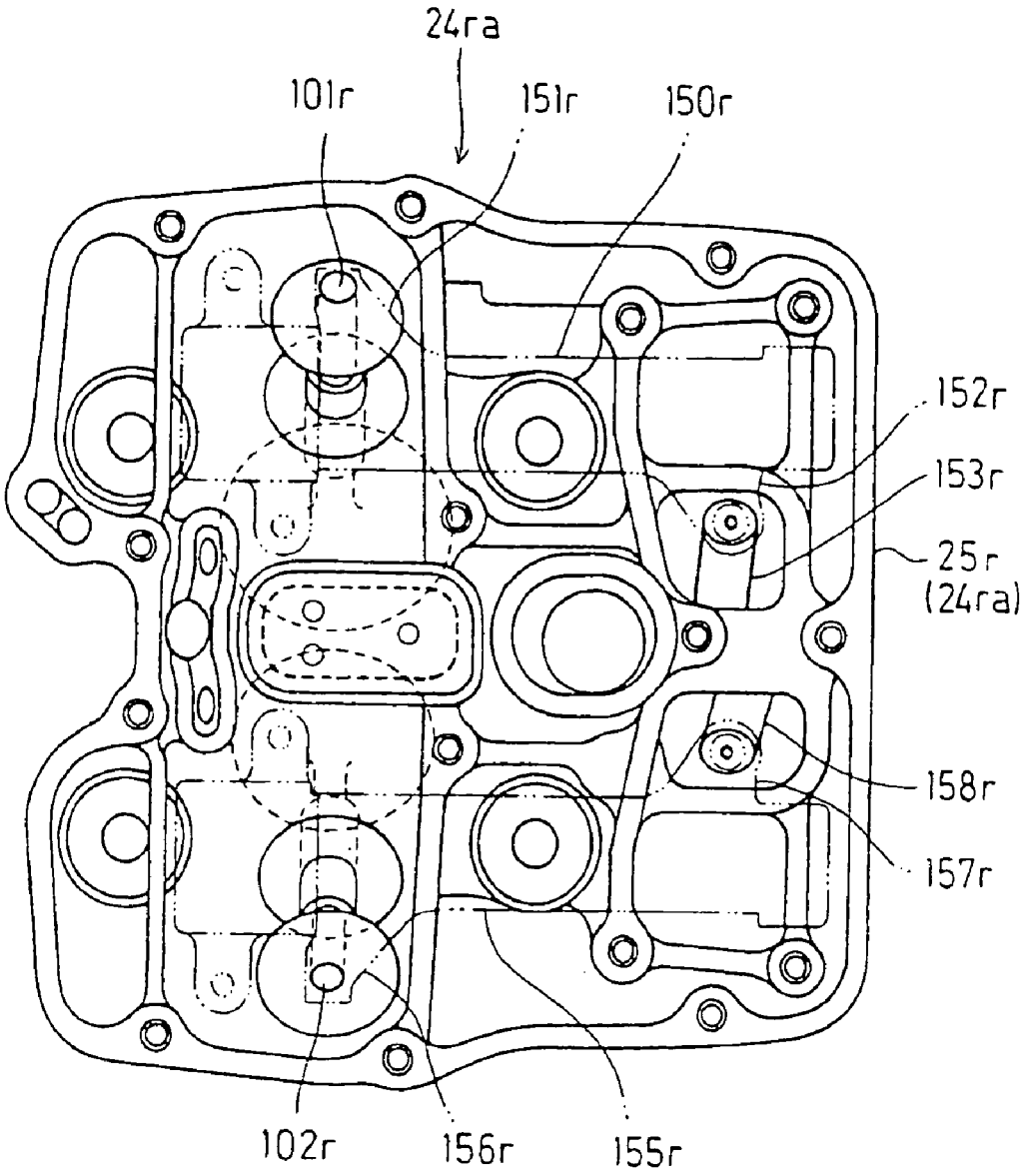
FIG. 3 is a top plan view of a rear-side cylinder head portion.

Referring to FIG. 3 which is a top plan view of the rear-side cylinder head portion 24*ra*, a rocker arm holder 25*r* stacked on the cylinder head 24*r* provided with the intake and exhaust systems as above holds rotatably an intake system rocker arm shaft 150*r* and an exhaust system rocker arm shaft 155*r* in the cylinder head cover 26*r*.

Referring to FIGS. 3 and 4, a rocker arm 151*r* for operating the intake valve 101*r* and a rocker arm 152*r* operated by an intake system push rod 153*r* are fitted to the intake system rocker arm shaft 150*r* located on the inner side of the V banks.

Similarly, a rocker arm 156*r* for operating the exhaust valve 102*r* and a rocker arm 157*r* operated by an exhaust system push rod 158*r* are fitted to the exhaust system rocker arm shaft 155*r* located on the outer side of the V banks.

The intake system push rod 153*r* and the exhaust system push rod 158*r* are in contact with the rocker arm 152*r* and the rocker arm 157*r* inside the cylinder head cover 26*r* at their upper ends, whereas their lower ends are connected to a valve operating cam mechanism 160 in the clutch gear case 28 provided in the right-side crankcase 22, and their elongate portions other than their upper and lower ends are disposed on the outside of and along right surfaces of the cylinder 23*r* and the cylinder head 24*r*.

Thus, this valve operating mechanism is of the OHV system, wherein the valve operating cam mechanism 160 is provided on the crankcase 22 side, and the intake valve 101*r* and the exhaust valve 102*r* provided in the cylinder head 24*r* are driven through the push rods 153*r*, 158*r*.

Incidentally, the same structure is adopted for the front-side cylinder head 24*f*.

The valve operating cam mechanism 160 in the clutch gear case 28 has a configuration in which the cam shafts 161*r* (the cam shaft for the front side bank, 161*f*, is not shown) are rotatably supported on the skew upper front and rear sides of a right end portion of the crankshaft 21, in parallel to the crankshaft 21.

Referring to FIG. 4, the rear bank cam shaft 161*r* penetrates through a side wall of the clutch gear case 28 to project rightwards, and a driven sprocket 162*f*, 162*r* is fitted to the projecting end of the cam shaft 161*r*. Chains 163 are wrapped around the drive sprocket 52, which is attached to the tip end of the cap 51 fitted over the crankshaft 21 projecting to the right through the opening in the clutch gear case 28, and the driven sprockets 162*r* located on the skew upper front and rear sides.

The driven sprocket 162*r* has teeth the number of which is twice the number of teeth of the drive sprocket 52. Therefore, when the rotation of the crankshaft 21 is transmitted from the drive sprocket 52 through the chain 163 to the driven sprocket 162*r*, the rear bank cam shaft 161*r* is rotated together with the driven sprocket 162*r* at a rotating speed of one half of that of the crankshaft 21.

Referring to FIG. 4, the rear bank cam shaft 161*r* is formed with two pairs of cams, i.e., an adjacent pair of high-speed cam and low-speed cam for intake, and an adjacent pair of high-speed cam and low-speed cam for exhaust. Rollers of four rocker arms 164*r* abut on the cams, the four rocker arms 164*r* are swingably supported on a common rocker arm shaft 165*r*, and the rollers of the high-speed rocker arms 164*r*, 164*r* are pressed against the cams by springy biasing means 166*r*.

The rocker arm shaft 165*r* is provided therein with an oil hydraulic passage, and an oil pressure can be applied to an engaging/disengaging mechanism formed between the high-speed rocker arm 164*r* and the low-speed rocker arm 164*r* corresponding to the high-speed and low-speed cams, and swinging ends of the low-speed rocker arms 164*r*, 164*r* bear lower end portions of the intake system push rod 153*r* and the exhaust system push rod 158*r*.

Therefore, when an oil pressure is not applied to the engaging/disengaging mechanism, the high-speed rocker arm 164*r* and the low-speed rocker arm 164*r* are disengaged and are swung independently from each other, the intake system push rod 153*r* and the exhaust system push rod 158*r* borne by the tip end of the low-speed rocker arm 164*r* are moved up and down according to the low-speed cams, and the intake valve 101*r* and the exhaust valve 102*r* are operated at low-speed valve timings.

On the other hand, when the oil pressure is applied to the engaging/disengaging mechanism, the high-speed rocker arm 164*r* and the low-speed rocker arm 164*r* are engaged to be swung as one body, the intake system push rod 153*r* and the exhaust system push rod 158*r* borne by the tip end of the low-speed rocker arm 164*r* are moved up and down according to the low-speed cams, and the intake valve 101*r* and the exhaust valve 102*r* are operated at high-speed valve timings.

The front bank cam shaft is configured symmetrically with the rear bank cam shaft 161*r* on the front and rear sides, wherein members equivalent to the above, i.e., four rocker arms, rocker arm shaft, and springy biasing means together with an intake system push rod and an exhaust system push rod constitute the same structure as above. When an oil pressure is not applied to the engaging/disengaging mechanism, the intake valve 101*f* and the exhaust valve 102*f* are operated at low-speed valve timings, and when the oil pressure is applied to the engaging/disengaging mechanism, the intake valve 101*f* and the exhaust valve 102*f* are operated at high-speed valve timings.

Figure 5:
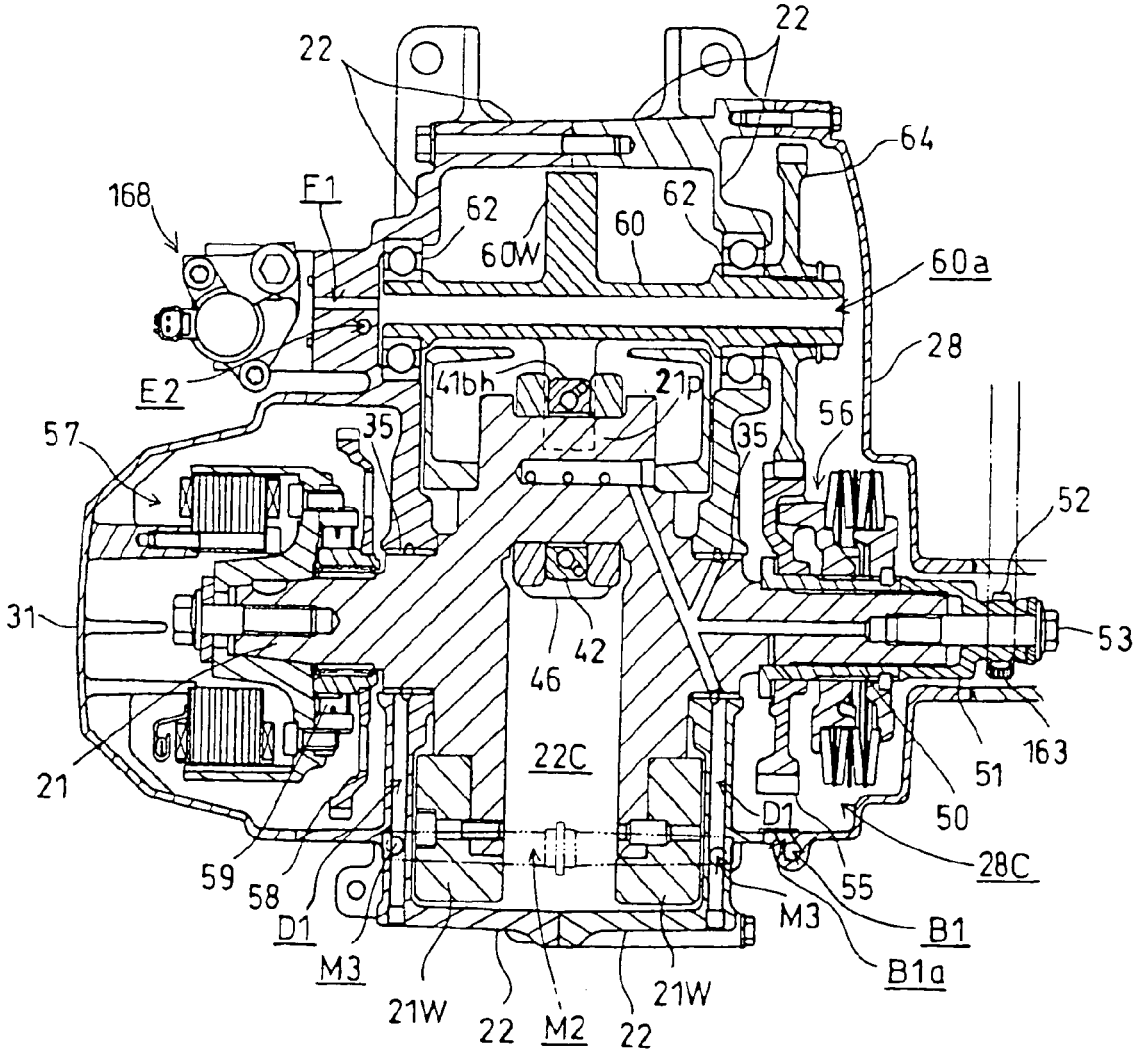
FIG. 5 is a sectional view taken along line V-V of FIG. 2.

An oil pressure control valve 168 for controlling the oil pressure applied to the engaging/disengaging mechanism is attached to a side wall of the left-side crankcase 22, at a position corresponding to a left extension portion of the front-side balancer shaft 60 (see FIG. 5).

The oil pressure control valve 168 attached to the left-side crankcase 22 at the position is covered with the side cover 36 (see FIG. 1).

Now, a lubricating system will be described below.

The left and right crank webs 21*w*, 21*w* of the crankshaft 21 and the connecting projected portion 46*c* of the big end portions 45*b*, 45*b* of the rear-side connecting rod 45 between the crank webs 21*w*, 21*w* are swiveled in the crank chamber 22C. As shown in FIG. 10, at a bottom portion of the crankcase 22, an arcuate oil sump 170 is formed along the locus of the maximum diameter in swiveling of the connecting projected portion 46*c*, an oil discharge port 171 is opened adjacent to and on the rear side of the oil sump 170, and communicated with a small oil chamber 172 provided adjacent to and on the rear side of the oil sump 170.

The oil discharge port 171 has a configuration in which a part of the bottom wall of the oil sump 170 projects slightly upwards into the small oil chamber 172, forming a discharge guide rib 171*a*, and a lead-out port A1*a* is opened in a rear portion along the bottom surface of the small oil chamber 172.

The discharge guide rib 171*a* projecting into the small oil chamber 172 prevents an oil from returning from the small oil chamber 172 into the oil sump 170.

The lead-out port A1*a* is an opening of a communicating oil passage A1 communicated with an oil pipe A2 laid in the mission chamber 27C, and the oil pipe A2 is communicated with a suction oil passage A3 through which the oil is sucked into the crank chamber scavenging pump 86 of the oil pump 85.

As shown in FIG. 10, referring to the motion of the connecting projected portion 46*c* of the big end portions 45*b*, 45*b* of the rear-side connecting rod 45, the connecting projected portion 46*c* is immersed into the oil collected in the oil sump 170 from the front side in the vicinity of the bottom dead center of the piston 40*r* in the rear bank cylinder 23*r* inclined rearwards, and is then swiveled toward the oil discharge port 171 on the rear side. As a result, referring to the connecting projected portion 46*c*' and 46*c*" indicated by two-dotted chain lines in FIG. 10, a flat surface of a rear surface 46*cb* of the connecting projected portion 46*c* pushes the oil collected in the oil sump 170 to effectively rake out the oil to the oil discharge port 171 (the surface condition of the oil at the time of the connecting projected portion 46*c*' is indicated by two-dotted chain line in FIG. 10), whereby the oil can be efficiently discharged from the oil sump 170 into the small oil chamber 172.

The connecting projected portion 46*c* thus raking out the oil collected in the oil sump 170 is preferably provided at the big end portions 45*b*, 45*b* of the rear-side connecting rod 45, rather than provided on the front-side connecting rod 41. As shown in FIG. 10, this configuration ensures that the connecting projected portion 46*c* can function more effectively to rake out the oil into the oil discharge port 171, and can discharge the oil more efficiently.

In addition, the rear surface 46*cb* of the connecting projected portion 46*c* may be formed in a concave shape so as to increase the amount of the oil raked out at a time.

Since the big end portions 45*b*, 45*b* of the rear-side connecting rod 45 is separable in two at a plane perpendicular to the rod axis, the pair of semi-circular arcuate big end halves 46*bc*, 46*bc* of the connecting rod cap 46 can be formed integrally, whereby processing and assembly can be facilitated.

The pair of semi-circular arcuate big end halves 46*bc*, 46*bc* of the connecting rod cap 46 are mated to the rod main body side big end half bodies 45*bh*, 45*bh*, and the four corners of them are fastened on both sides of the connecting projected portion 46*c* by the connecting rod bolts 47, to constitute the big end portions 45*b*, 45*b*. This ensures that the shape of the connecting projected portion 46*c* is not restricted by the connecting rod bolts 47, so that a shape promising efficient raking-out of the oil can be formed easily and with a high degree of freedom.

Thus, the oil collected in the oil sump 170 in the crank chamber 22C is discharged through the oil discharge port 171 into the small oil chamber 172 through the raking-out by the connecting projected portion 46*c* of the rear-side connecting rod 45, the oil discharged into the small oil chamber 172 is led through the lead-out port A1*a* into the communicating oil passage A1, and is sucked through the oil pipe A2 and the suction oil passage A3 into the left-side crank chamber scavenging pump 86 of the oil pump 85 (see FIG. 2).

A discharge pipe 175 is extended upwards from the crank chamber scavenging pump 86, and the oil discharged by the crank chamber scavenging pump 86 is supplied as a jet of droplets from the discharge pipe 175 to the main gear train and the counter gear train which are meshed with each other in the mission chamber 27C.

On the other hand, referring to FIGS. 2 and 5, the bottom wall of the clutch gear case 28 is provided with an oil passage B1 extending from the lower side of the primary gear 55 toward the rear side and extending to the rear side of the rear-side balancer gear 65. The oil passage B1 opens a communicating port B1*a* in the vicinity of the lower side of the primary gear 55 to be thereby communicated with the clutch chamber 28C, the rear end of the oil passage B1 is communicated with a strainer (not shown) disposed in a swollen state in the clutch chamber 28C, and the suction oil passage is connected to the right-side clutch chamber scavenging pump 88 of the oil pump 85 through the strainer (see FIG. 6).

Therefore, with the clutch chamber scavenging pump 88 operated, the oil in the clutch chamber 28C is sucked via the oil passage B1 and through the strainer.

Referring to FIGS. 2 and 6, the oil collected at the bottom of the mission chamber 27C is sucked by the center feed pump 87 of the oil pump 85 via the strainer 185 and the suction pipe C1.

Then, the oil is discharged from the feed pump 87 into an discharge oil passage C2, which is connected to an inflow port of an oil filter 186 attached to the lower side of a rear portion of the mission case 27, and the oil is caused to flow out from the oil filter 186 into a main gallery M.

The main gallery M has a configuration in which a main oil passage M1 extending forwards from the oil filter 186 is communicated with a main oil passage M2 directed in the left-right direction while expanding into the small oil chamber 172 adjacent to and on the rear side of the crank chamber 22C, the oil passage is bent at left and right ends of the main oil passage M2, from which main oil passages M3, M3 are extended in the front-rear direction through side walls of the left and right side crankcases 22, and oil passages D1, D1 branched upwards from intermediate portions of the main oil passages M3, M3 extended forwards supply the oil to left and right journal portions of the crankshaft 21 (see FIGS. 2 and 5).

Referring to FIG. 2, the main oil passage M3 extending forwards in the left-side crankcase 22 extends upwards at the front end beyond the branching point of the oil passage D1, and is then bent forwards to be communicated with an oil passage E1, which leads to the oil pressure control valve 168.

From the oil pressure control valve 168, an oil passage F1 extends in the left-side crankcase 22 toward the front-side balancer shaft 60 on the right side (see FIG. 5), and an oil passage E2 extends upwards (see FIG. 2).

The oil pressure control valve 168 can switch between the feeding of the hydraulic oil flowing in through the oil passage E1 into the oil passage E2 extending upwards and the feeding of the oil out into an oil passage F1 extending toward the front-side balancer shaft 60.

The oil passage E2 extending upwards is bent to the right side at its upper end, to be an oil passage E3 extending to the right-side crankcase 22. Referring to FIG. 2, the oil passage E3 is bent at a side wall of the right-side crankcase 22 to the skewly rear upper side, to be an oil passage E4 extending horizontally rearwards. The oil passage E4 is bent to the skew upper side, to be an oil passage E5 communicated with the oil pressure passage in the rear-side rocker arm shaft 165*r* of the valve operating cam mechanism 160. An oil passage E6 branched to the skew front side from an intermediate portion of the oil passage E5 is communicated with the oil pressure passage in the front-side rocker arm shaft 165*f*.

The oil passages in the front and rear rocker arm shafts 165*f*, 165*r* are communicated with the engaging/disengaging mechanism for the rocker arms 164*f*, 164*r*, whereby oil pressures can be applied.

Therefore, when the oil pressure control valve 168 feeds the hydraulic oil into the oil passage E1, the oil pressure can be applied to the engaging/disengaging mechanism, whereby the intake valves 101*f*, 101*r* and the exhaust valves 102*f*, 102*r* are operated at high-speed valve timings.

On the other hand, when the oil pressure control valve 168 switches the valve to feed the oil out into the oil passage E1, the oil pressure is not applied to the engaging/disengaging mechanism, so that the intake valves 101*f*, 101*r* and the exhaust valves 102*f*, 102*r* are operated at low-speed valve timings.

In this case, as shown in FIG. 5, the oil flowing out into the oil passage F1 is supplied to the left-side bearing 62 for the front-side balancer shaft 60, and flows through the center hole 60*a* in the front-side balancer shaft 60 to be discharged through the right end opening into the crank chamber 22C.

In the front-rear V-type internal combustion engine 20 as above, the idle air controller 131 provided at an upper portion of the throttle body 120 in the intake system structured on the inner side of the V banks has a configuration in which, as shown in FIG. 8, the idle control valve 133 screw engaged with the rotational drive shaft 135 projecting to the rear side of the motor 134 opens and closes the bypass passage 132 by being moved in the front-rear direction orthogonal to the upstream-side intake pipe 110*c* directed in the left-right direction parallel to the crankshaft 21. Thus, in this configuration, the motor 134, the rotational drive shaft 135 and the idle control valve 133 are aligned in the front-rear direction orthogonal to the upstream-side intake pipe 110*c*, and the idle control valve 133 opens and closes the bypass passage 132 by being moved in the front-rear direction, while being located at the center in the left-right width direction of the throttle body 120. Therefore, the left-right width of the throttle body 120 is not enlarged, and the overall width of the internal combustion engine 20 in the left-right direction can be suppressed to be small.

The motor 134, the rotational drive shaft 135 and the idle control valve 133 aligned in the front-rear direction are located within the left-right width of the V-type internal combustion engine 20, as shown in FIG. 8.

Therefore, since the throttle body 120 is not enlarged in the width direction, the air cleaner 130 disposed on a lateral side of the throttle body 120 would not largely project to the lateral side to thereby spoil the appearance quality, the possibility of widening the distance between the knees of the rider too much can be obviated, and enhancement of the riding position can be contrived.

Since the idle control valve 133 is disposed on the upper side on the throttle body 120, the idle control valve 133 can be spaced from the cylinders 23*f*, 23*r*, and the thermal influence on the idle control valve 133 from the cylinders 23*f*, 23*r* can be suppressed.

In this V-type internal combustion engine 20, the center axes of the cylinders 23*f*, 23*r* opposed to each other in V pattern are not set off but present on the same plane orthogonal to the crankshaft 21; therefore, the V type internal combustion engine 20 is narrow in width. Since the idle air controller 131 including the idle control valve 133 and the like is located within the narrow width, the overall width of the internal combustion engine 20 can be kept small.

Since the throttle sensor 126 for detecting the opening of the intake passage determined by the throttle valve 121 and the motor 134 for controlling the opening of the bypass passage 132 are both disposed on the front side of the throttle body 120, the harness extending from the throttle sensor 126 and the harness extending from the motor 134 can be collectively laid on one side, so that the harnesses can be laid around easily.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An intake structure for an internal combustion engine having cylinders banked in a V pattern, comprising:

a throttle body interposed in an intake passage extending to the inside of the V banks and bent to be parallel to a crankshaft;

a throttle valve disposed in the throttle body;

a bypass passage provided in said throttle body for bypassing said throttle valve;

an idle control valve added to said throttle body for opening and closing said bypass passage by being movable in a direction orthogonal to said intake passage and parallel to said crankshaft; and a drive shaft for moving said idle control valve projects from an electric actuator in the state of being directed in the moving direction of said idle control valve.

2. The intake structure for an internal combustion engine as set forth in claim 1, wherein said idle control valve is disposed on the upper side of said throttle body.

3. The intake structure for an internal combustion engine as set forth in claim 1, wherein center axes of said cylinders opposed to each other in V pattern are on the same plane orthogonal to said crankshaft; and said idle control valve is located within a width of said internal combustion engine in the direction in which said crankshaft is directed.

4. The intake structure for an internal combustion engine as set forth in claim 2, wherein center axes of said cylinders opposed to each other in V pattern are on the same plane orthogonal to said crankshaft; and said idle control valve is located within a width of said internal combustion engine in the direction in which said crankshaft is directed.

5. The intake structure for an internal combustion engine as set forth in claim 1, wherein said throttle body is provided with a throttle sensor for detecting the opening of said intake passage by said throttle valve; and said electric actuator is provided on the same side as said throttle sensor in said throttle body.

6. The intake structure for an internal combustion engine as set forth in claim 2, wherein said throttle body is provided with a throttle sensor for detecting the opening of said intake passage by said throttle valve; and said electric actuator is provided on the same side as said throttle sensor in said throttle body.

7. The intake structure for an internal combustion engine as set forth in claim 3, wherein said throttle body is provided with a throttle sensor for detecting the opening of said intake passage by said throttle valve; and said electric actuator is provided on the same side as said throttle sensor in said throttle body.

8. The intake structure for an internal combustion engine as set forth in claim 1, wherein the idle control valve is fitted orthogonally to a portion of the bypass passage that is directed in a left-right direction, so as to be movable in a front-rear direction, in order to open and close the bypass passage.

9. The intake structure for an internal combustion engine as set forth in claim 1, wherein the intake passage extends rightwards from two branches of an intake pipe, one branch of the intake pipe extending forward to a front-side cylinder head, and the second branch extending rearward to a rear-side cylinder head.

10. The intake structure for an internal combustion engine as set forth in claim 1, wherein a throttle valve shaft of the throttle valve is turnably disposed in a front-rear direction, the direction being orthogonal to the intake passage.

11. An intake structure for an internal combustion engine having cylinders banked in a V pattern, comprising:

a throttle body interposed in an intake passage, the intake passage having upstream portion extending parallel to a crankshaft and a downstream portion extending to insides of the V banks;

a throttle valve disposed in the throttle body;

a bypass passage provided in said throttle body for bypassing said throttle valve;

an idle control valve added to said throttle body for opening and closing said bypass passage by being movable in a direction orthogonal to said intake passage and parallel to said crankshaft; and a drive shaft for moving said idle control valve projects from an electric actuator in the state of being directed in the moving direction of said idle control valve, and when during an idling operation the throttle valve is fully closed, air intake is secured through the bypass passage.

12. The intake structure for an internal combustion engine as set forth in claim 11, wherein said idle control valve is disposed on the upper side of said throttle body.

13. The intake structure for an internal combustion engine as set forth in claim 11, wherein center axes of said cylinders opposed to each other in V pattern are on the same plane orthogonal to said crankshaft; and said idle control valve is located within a width of said internal combustion engine in the direction in which said crankshaft is directed.

14. The intake structure for an internal combustion engine as set forth in claim 12, wherein center axes of said cylinders opposed to each other in V pattern are on the same plane orthogonal to said crankshaft; and said idle control valve is located within a width of said internal combustion engine in the direction in which said crankshaft is directed.

15. The intake structure for an internal combustion engine as set forth in claim 11, wherein said throttle body is provided with a throttle sensor for detecting the opening of said intake passage by said throttle valve; and said electric actuator is provided on the same side as said throttle sensor in said throttle body.

16. The intake structure for an internal combustion engine as set forth in claim 12, wherein said throttle body is provided with a throttle sensor for detecting the opening of said intake passage by said throttle valve; and said electric actuator is provided on the same side as said throttle sensor in said throttle body.

17. The intake structure for an internal combustion engine as set forth in claim 13, wherein said throttle body is provided with a throttle sensor for detecting the opening of said intake passage by said throttle valve; and said electric actuator is provided on the same side as said throttle sensor in said throttle body.

18. The intake structure for an internal combustion engine as set forth in claim 11, wherein the idle control valve is fitted orthogonally to a portion of the bypass passage that is directed in a left-right direction, so as to be movable in a front-rear direction, in order to open and close the bypass passage.

19. The intake structure for an internal combustion engine as set forth in claim 11, wherein the intake passage extends rightwards from two branches of an intake pipe, one branch of the intake pipe extending forward to a front-side cylinder head, and the second branch extending rearward to a rear-side cylinder head.

20. The intake structure for an internal combustion engine as set forth in claim 11, wherein a throttle valve shaft of the throttle valve is turnably disposed in a front-rear direction, the direction being orthogonal to the intake passage.

* * * * *